US005377976A

United States Patent [19]

Matherne et al.

[11] Patent Number: 5,377,976

[45] Date of Patent: Jan. 3, 1995

[54] PORTABLE BASKETBALL SYSTEM

[75] Inventors: Lonny R. Matherne, Pleasant View; Barry D. Mower; Kelly Taylor, both of Layton, all of Utah

[73] Assignee: Lifetime Products, Inc., Clearfield, Utah

[21] Appl. No.: 97,678

[22] Filed: Jul. 27, 1993

Related U.S. Application Data

[63] Continuation-in-part of Ser. No. 13,611, Feb. 4, 1993, Pat. No. 5,248,140.

[51] Int. Cl.[6] ..... A63B 63/08; F16M 13/00

[52] U.S. Cl. ..... 273/1.5 R; 206/315.1; 206/579; 248/519; 248/910

[58] Field of Search ..... 273/1.5 R.1.5 A; 206/315.1, 579; 248/519–529, 910

[56] References Cited

U.S. PATENT DOCUMENTS

| | | | |
|---|---|---|---|
| 169,181 | 10/1875 | Leonard . | |
| 193,015 | 7/1877 | McCarthy . | |
| 419,137 | 1/1890 | Bobemerith . | |
| 589,261 | 8/1897 | Koch et al. . | |
| 650,211 | 5/1800 | Wirth . | |
| 1,090,291 | 3/1914 | Engelhart . | |
| 1,310,323 | 7/1919 | Centolella . | |
| 1,504,292 | 8/1924 | Wickes . | |
| 1,667,887 | 5/1928 | Fallert . | |
| 1,669,169 | 5/1928 | Moss . | |
| 1,906,622 | 5/1933 | Kondolf . | |
| 1,924,811 | 8/1933 | Schultz | 273/1.5 |
| 1,926,674 | 9/1933 | Gross | 273/1 |
| 2,227,310 | 12/1940 | Hoppes et al. | 273/1.5 |
| 2,230,813 | 2/1941 | Pressman | 273/1.5 |
| 2,457,908 | 1/1949 | Meyerhoefer | 285/163 |
| 2,500,720 | 3/1950 | van Der Heem | 285/161 |
| 2,519,466 | 8/1950 | Hauser | 45/137 |
| 2,534,067 | 12/1950 | Rubin | 273/1.5 |
| 2,594,628 | 4/1952 | Evans | 229/6 |
| 2,757,888 | 8/1956 | Branstrator | 248/4 |
| 2,791,363 | 5/1957 | Boeye | 229/16 |
| 2,818,254 | 12/1957 | Dunn | 273/1.5 |
| 2,865,133 | 12/1958 | Hoven et al. | 45/137 |
| 2,898,065 | 8/1959 | Ackley | 248/40 |
| 2,930,559 | 3/1960 | Lohr | 248/44 |
| 3,017,183 | 1/1962 | Chalcroft | 273/1.5 |
| 3,025,058 | 3/1962 | Brumfield | 273/1.5 |
| 3,027,061 | 3/1962 | Locke | 229/16 |
| 3,094,303 | 6/1963 | Belger | 248/40 |
| 3,161,395 | 12/1964 | Carter | 248/354 |
| 3,184,207 | 5/1965 | Hermanns et al. | 248/413 |
| 3,194,555 | 7/1965 | Humphrey | 273/1.5 |
| 3,376,068 | 4/1968 | Walkinshaw | 297/437 |
| 3,399,889 | 8/1968 | Harry | 273/1.5 |
| 3,427,025 | 2/1969 | Procter | 273/1.5 |
| 3,469,870 | 9/1969 | Barkus | 287/58 |
| 3,497,057 | 2/1970 | Traner et al. | 206/44.11 |
| 3,614,143 | 10/1971 | Stevens | 287/126 |
| 3,697,103 | 10/1972 | Mostyn | 287/58 CT |
| 3,716,234 | 2/1973 | Lancellotti | 273/1.5 R |
| 3,731,897 | 5/1973 | Price | 248/230 |
| 3,780,933 | 12/1973 | Freeman | 229/40 |

(List continued on next page.)

FOREIGN PATENT DOCUMENTS

| | | |
|---|---|---|
| 544020 | 9/1922 | France . |

(List continued on next page.)

OTHER PUBLICATIONS

Huffy Sports, "A World Full of Family Fun," Product Brochure.

(List continued on next page.)

*Primary Examiner*—William H. Grieb
*Attorney, Agent, or Firm*—Madson & Metcalf

[57] ABSTRACT

A portable basketball system with a ballast-fillable base configured to house the component parts of the basketball system is disclosed. The basketball system includes a base, a backboard, a basketball goal, a pole, and means for affixing the backboard and goal to the pole. The base includes molded recesses for retaining the backboard, basketball goal, a plurality of pole sections, which are joined together to form the pole, and the means for affixing the backboard and goal to the pole, such as threaded fasteners. The backboard functions as a lid to retain the component parts within their respective recesses in the base. A handle is located on the exterior surface of the base for transporting the component parts of the basketball system, much like a suitcase.

33 Claims, 4 Drawing Sheets

U.S. PATENT DOCUMENTS

| | | | |
|---|---|---|---|
| 3,788,642 | 1/1974 | Matras et al. | 273/1.5 R |
| 3,795,396 | 3/1974 | Kropelnitski | 272/59 C |
| 3,802,702 | 4/1974 | Pulley | 273/1.5 R |
| 3,820,784 | 6/1974 | Boitano et al. | 273/1.5 R |
| 3,830,008 | 8/1974 | Johnson | 43/18 R |
| 3,841,631 | 10/1974 | Dolan | 273/1.5 R |
| 3,854,168 | 12/1974 | Bradley | 17/44.2 |
| 3,880,392 | 4/1975 | Duganich | 248/324 |
| 3,896,987 | 7/1975 | Soja | 229/33 |
| 3,900,194 | 8/1975 | Ward et al. | 272/1 B |
| 3,918,711 | 11/1975 | Zak | 273/29 A |
| 3,929,225 | 12/1975 | Locke et al. | 206/335 |
| 3,936,206 | 2/1976 | Meisberger | 403/334 |
| 3,949,932 | 4/1976 | Shore | 229/40 |
| 4,009,779 | 3/1977 | Frye | 206/315 R |
| 4,009,780 | 3/1977 | Frye | 206/315 R |
| 4,017,998 | 4/1977 | Dumler | 43/21.2 |
| 4,061,367 | 12/1977 | Moebius | 285/382.2 |
| 4,114,764 | 9/1978 | Rich | 211/100 |
| 4,145,044 | 3/1979 | Wilson et al. | 273/1.5 R |
| 4,151,989 | 5/1979 | Dittrich | 273/1.5 A |
| 4,170,297 | 10/1979 | Johnson | 206/326 |
| 4,197,778 | 4/1980 | Wharton, Jr. | 93/36.01 |
| 4,289,298 | 9/1981 | Kameda | 254/8 B |
| 4,291,885 | 9/1981 | Cohen | 273/347 |
| 4,330,101 | 5/1982 | Andersen | 248/284 |
| 4,349,105 | 9/1982 | Bradley et al. | 206/317 |
| 4,377,283 | 3/1983 | Mahoney | 273/1.5 R |
| 4,412,679 | 11/1983 | Mahoney et al. | 273/1.5 R |
| 4,465,277 | 8/1984 | Dittrich | 273/1.5 A |
| 4,469,224 | 9/1984 | Ritter | 206/335 |
| 4,627,146 | 12/1986 | Ward | 29/458 |
| 4,653,646 | 3/1987 | Allen et al. | 206/579 |
| 4,684,129 | 8/1987 | Andersen et al. | 273/1.5 R |
| 4,735,392 | 4/1988 | Farmer | 248/439 |
| 4,747,597 | 5/1988 | Kluczny | 273/1.5 R |
| 4,759,545 | 7/1988 | Grable | 273/1.5 R |
| 4,769,897 | 9/1988 | Moseman | 29/525 |
| 4,826,162 | 5/1989 | Allen | 273/1.5 R |
| 4,842,134 | 6/1989 | Chang | 273/56 X |
| 4,842,152 | 6/1989 | Donegan | 215/294 |
| 4,869,501 | 9/1989 | Anastasakis | 273/1.5 R |
| 4,946,139 | 8/1990 | Tomellini | 256/64 |
| 4,979,754 | 12/1990 | Eisenhart | 273/411 |
| 5,014,983 | 5/1991 | Saunders | 273/1.5 R |
| 5,098,092 | 3/1992 | Aakre et al. | 273/1.5 R |
| 5,112,023 | 5/1992 | Sowers | 248/519 |
| 5,158,281 | 10/1992 | Williams | 273/1.5 R |
| 5,165,656 | 11/1992 | Schlessman et al. | 220/304 |
| 5,191,852 | 5/1993 | Rupp | 114/255 |
| 5,207,407 | 5/1993 | Fitzsimmons | 273/65 R X |
| 5,248,140 | 9/1993 | Matherne et al. | 273/1.5 R |
| 5,259,612 | 11/1993 | Matherne et al. | 273/1.5 R |

FOREIGN PATENT DOCUMENTS

| | | |
|---|---|---|
| 755442 | 11/1933 | France . |
| 1012572 | 7/1957 | Germany . |
| 2257389 | 6/1974 | Germany . |
| 908055 | 10/1962 | United Kingdom . |
| 1152846 | 5/1969 | United Kingdom . |
| 261156 | 5/1970 | U.S.S.R. . |

OTHER PUBLICATIONS

Huffy Sports, "7H20A Instra $H_2OOP$," Products Brochure.
Huffy Sports, "Slam Jam," Product Brochure.
Lifetime Products, Inc., "HoopMobile Model 7100," Product Brochure.
Diversified Products, "Economy Portable Free-Standing Basketball Goal," Owners Manual.
Lifetime Products, Inc., "Quick Court—Portable Basketball System," Product Brochure.
Porter, "Future-Pro-Portable Basketball Units," Product Brochure.
Porter, "Porter '535' Portable -Universal Apppeal," Product Brochure.
Porter, "State of the Art Technology," Product Brochure.
Porter, "Fiberglass Backboards," Product Brochure.
Porter, "Graphite Backboards," Product Brochure.
Porter, "Deluxe Graphite/Fiberglass Composite Backboard—The Hottest Product on the Market," Product Brochure.
Porter, "Basketball Poles," Product Brochure.
Porter, "Official Basketball Goals," Product Brochure.
Porter, "Mounting Brackets," Product Brochure.
Porter, "Basketball Nets," Product Brochure.
Porter, "Mini-Boards," Product Brochure.
Huffy Sports, "INSTA $H_2OOP$ Pole System Assembly 48" Backboard and Slam Jam Goal," Assembly Brochure.
Diversified Products, "AquaTite All-In-One," Product Brochure.
Diversified Products, "Ceramic All-In-One," Product Brochure.
Diversified Products, "All-In-One Basketball Set," Product Brochure.
Diversified Products, "Packaging Sequence for 40-0517C," Blue Prints.
Huffy Sports, "Ulta Packs," Product Brochure.
Lifetime Products, Inc., "Quick Court—Portable Basketball System," Instructions.
Lifetime Products, Inc., "Assembly of Quick Adjust Mechanism," Assembly Instructions.
Lifetime Products, Inc., "Accessories for Your Slam Dunk & Slam Dunk Pro System", Product Brochure.

PORTABLE BASKETBALL SYSTEM

RELATED PATENT APPLICATION

This invention is a continuation-in-part of U.S. patent application Ser. No. 08/013,611, filed Feb. 4, 1993, now. U.S. Pat. No. 5,248,148 titled "Apparatus And Method For Packaging A Basketball Goal System With Weight-Fillable Base," which application is incorporated herein by reference.

BACKGROUND OF THE INVENTION

1. Field of the Invention

The present invention is related to a portable basketball system with a weight-fillable base. More particularly, the present invention is related to a portable basketball system with a weight-fillable base configured to house the component parts of the basketball system.

2. Technology Review

The game of basketball is becoming increasingly popular for people of all ages. Although the majority of basketball systems are full-sized, i.e., 10 feet rim height, there are some miniature basketball systems available designed for use by children. Such miniature basketball systems typically include smaller-than-normal basketball rims and backboards, which use small-sized basketballs. The rim height often ranges from 4 to 6 feet. In some systems, the height is adjustable. These miniature basketball systems are useful for allowing small children to play basketball.

Although full-sized basketball systems are often permanently mounted, miniature basketball systems are usually portable. Portability is an important advantage of miniature basketball systems because it allows an adult to move the assembled basketball system to a play area, such as a driveway, and then return the basketball system to a storage area, such as a garage. Although these miniature basketball systems are sufficiently lightweight to be portable, their large size typically limits the ability to conveniently transport them more than a short distance. It is usually inconvenient to transport typical miniature basketball systems great distances, whether manually or, for example, in an automobile.

To be effective, any basketball system must have sufficient weight or strength to maintain the basketball goal in a generally rigid position for use in playing the game of basketball. A serious disadvantage of typical miniature basketball systems is that they lack sufficient weight or strength to provide a rigid backboard and goal. As a result, most basketball shots make such systems wobble or even knock them over.

Another significant disadvantage of most basketball systems (whether full-sized or miniature) is the need for various hand tools, such as screw drivers, pliers, wrenches, hammers, etc., for assembly. Sometimes the desired hand tools are not readily available. Because of the inconvenience of assembly, once basketball systems are fully assembled, they are not usually disassembled.

It will be appreciated that there is a need in the art for a portable basketball system which may be made lightweight for easy transport and which may provide sufficient weight to maintain the basketball goal in a generally rigid position. There is also a need in the art for portable basketball systems which may be assembled and disassembled without the need for hand tools and which may be conveniently stored and transported as desired.

Such portable basketball systems are disclosed and claimed herein.

SUMMARY OF THE INVENTION

The present invention is directed to a portable basketball system with a ballast-fillable base configured to house the component parts of the basketball system. In one embodiment, the basketball system includes a base, a backboard, a basketball goal, a pole, and means for affixing the backboard and goal to the pole. The base includes molded recesses for retaining the backboard, basketball goal, a plurality of pole sections, which are joined together to form the pole, and means for affixing the backboard and goal to the pole, such as screws.

The backboard functions as a lid to retain the goal, pole, and screws within their respective recesses in the base. Means for retaining the backboard within the backboard recess are provided. Such means preferably include retaining clips. A handle is located on the exterior surface of the base for transporting the component parts of the basketball system, much like a suitcase.

The pole has a proximal end and a distal end and preferably comprises a plurality of pole sections which when joined together end-to-end form the pole. The pole sections are preferably swaged and flared at opposite ends to facilitate assembly. The pole sections may include locking means, such as a snap button, to securely hold the pole sections together, yet allow rapid disassembly.

The backboard may be connected to the pole near the distal end of the pole in any customary fashion that secures the plane of the backboard in a vertical plane. The basketball goal typically comprises a connecting plate, a rim, and a net which can be connected to the pole in a customary fashion such that the plane of the rim lies in a horizontal plane above a playing surface. The basketball goal may be connected to the pole by direct attachment to the pole or by indirect attachment to the pole through the backboard which is connected to the pole. In a currently preferred embodiment, the means for affixing the backboard and goal to the pole include screws which may be manually tightened without hand tools.

The base includes a pole recess which receives and supports the pole in a stationary, substantially upward disposition (for the purposes of this application substantially upward disposition shall include vertical disposition and a disposition angled from the vertical). In a currently preferred embodiment of the present invention, the base has a generally rectangular three-dimensional shape with a top and a bottom. The proximal end of the pole is configured to press fit into the pole recess so that the pole is held in a stationary disposition whether it be vertical or angled from the vertical. When the pole is held in its stationary disposition it is secured so that the basketball goal can be suspended at an elevation above the base and the playing surface upon which the base rests.

The base of the present invention has an interior hollow cavity for receiving ballast material and an exterior contour for receiving and retaining the pole sections, basketball goal, and backboard. The hollow cavity is accessed through an opening, preferably disposed on the top surface of the base. A cap is provided to cover the opening so that the hollow cavity can be made water tight. Hence, the ballast material used to provide the weight needed to securely anchor the basketball system to the playing surface during a game mode may be water or a solid particle ballast such as sand, soil, metal beads or the like. The weight of the ballast material provides sufficient support to the basketball system to maintain the system in a substantially rigid position during use of the basketball system.

The exterior contour of the base accommodates the receipt and retention of the other component parts of the basketball system in an assemblage that impedes shifting movement of the pole sections, backboard, and basketball goal within the container during shipping. The exterior contour of the base includes a backboard recess, a goal recess, and a pole recess for receiving and retaining the backboard, goal, and pole sections, respectively. The recesses are preferably provided on the bottom of the base, although it will be appreciated that some or all of the recesses may alternatively be provided on the top of the base. The pole recess, for example, is of the depth, size and shape for receiving and retaining the pole sections in secure but removable engagement. Likewise, the goal recess receives and retains the basketball goal in snug but removable engagement. The backboard recess is of a size and shape for receiving and retaining the backboard in fitted, removable engagement. The base also preferably includes recesses for retaining screws for affixing the backboard and basketball goal to the pole.

By positioning the pole sections within the pole recess, the basketball goal within the goal recess, and the backboard within the backboard recess, the assemblage has compact exterior dimensions for easy storage and transport. The backboard functions as a lid in combination with the base recesses to hold the component parts snugly and to impede the shifting movement of the pole sections, backboard, basketball goal, and other small component parts during transport. When disassembled, the basketball system is readily moved by using a handle located on the exterior surface of the base.

DETAILED DESCRIPTION OF THE INVENTION

Figure 1:
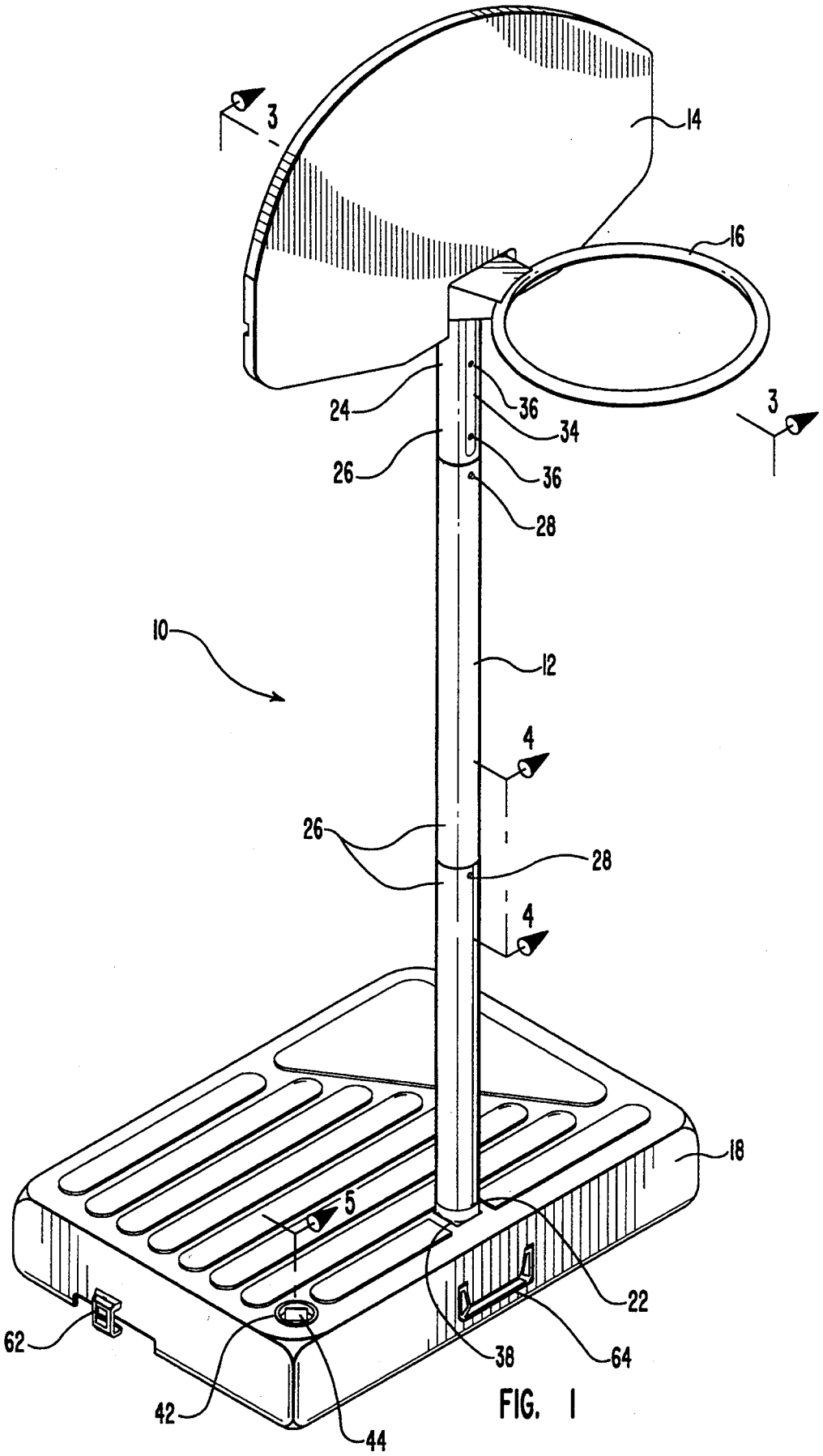
FIG. 1 is a perspective view of one embodiment of the portable basketball system of the present invention as it would appear assembled.

Reference is now made to the figures wherein like parts are referred to by like numerals throughout. With particular reference to FIG. 1, a portable basketball system according to the present invention is generally designated at 10. The basketball system 10 comprises a pole 12, a backboard 14, a basketball goal 16, and a base 18.

Figure 4:
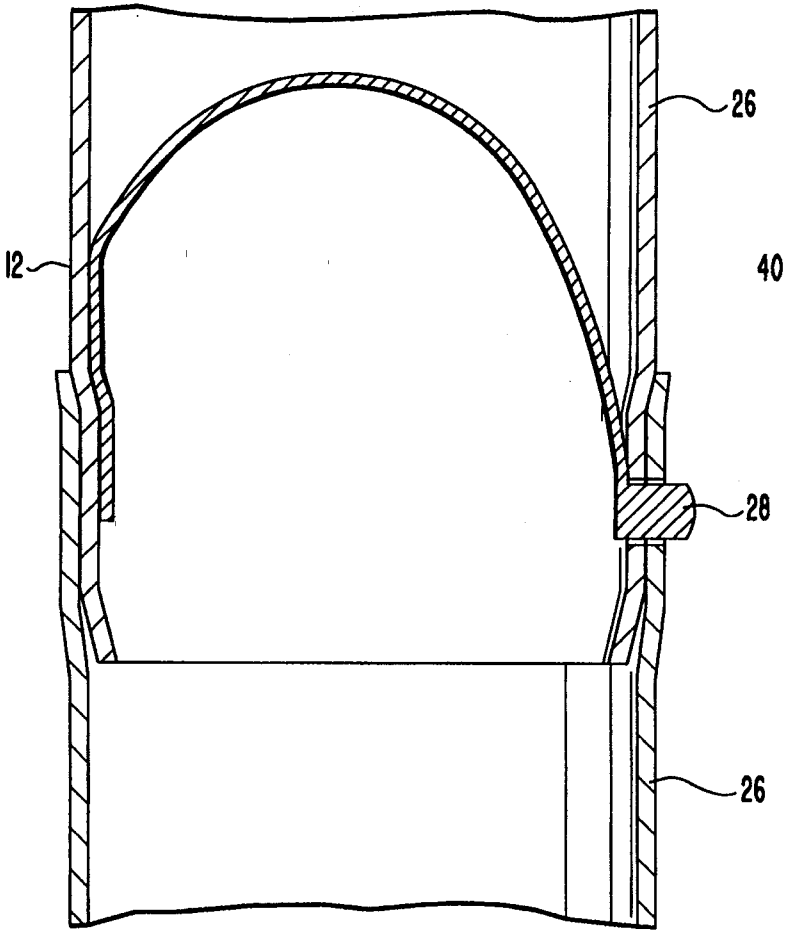
FIG. 4 is a cross-sectional view taken along line 4—4 of FIG. 1 illustrating a method of assembling the pole sections together to form the pole.

The pole 12 has a proximal end 22 and a distal end 24 and preferably comprises a plurality of pole sections 26 which when joined together end to end form the pole 12. The pole sections 26 may be joined together end to end in any conventional manner. As illustrated more clearly in FIG. 4, the pole sections 26 are preferably swaged and flared at opposite ends to facilitate assembly. The pole sections 26 may include locking means, such as a snap button 28, to securely hold the pole sections 26 together, yet allow rapid disassembly.

Figure 3:
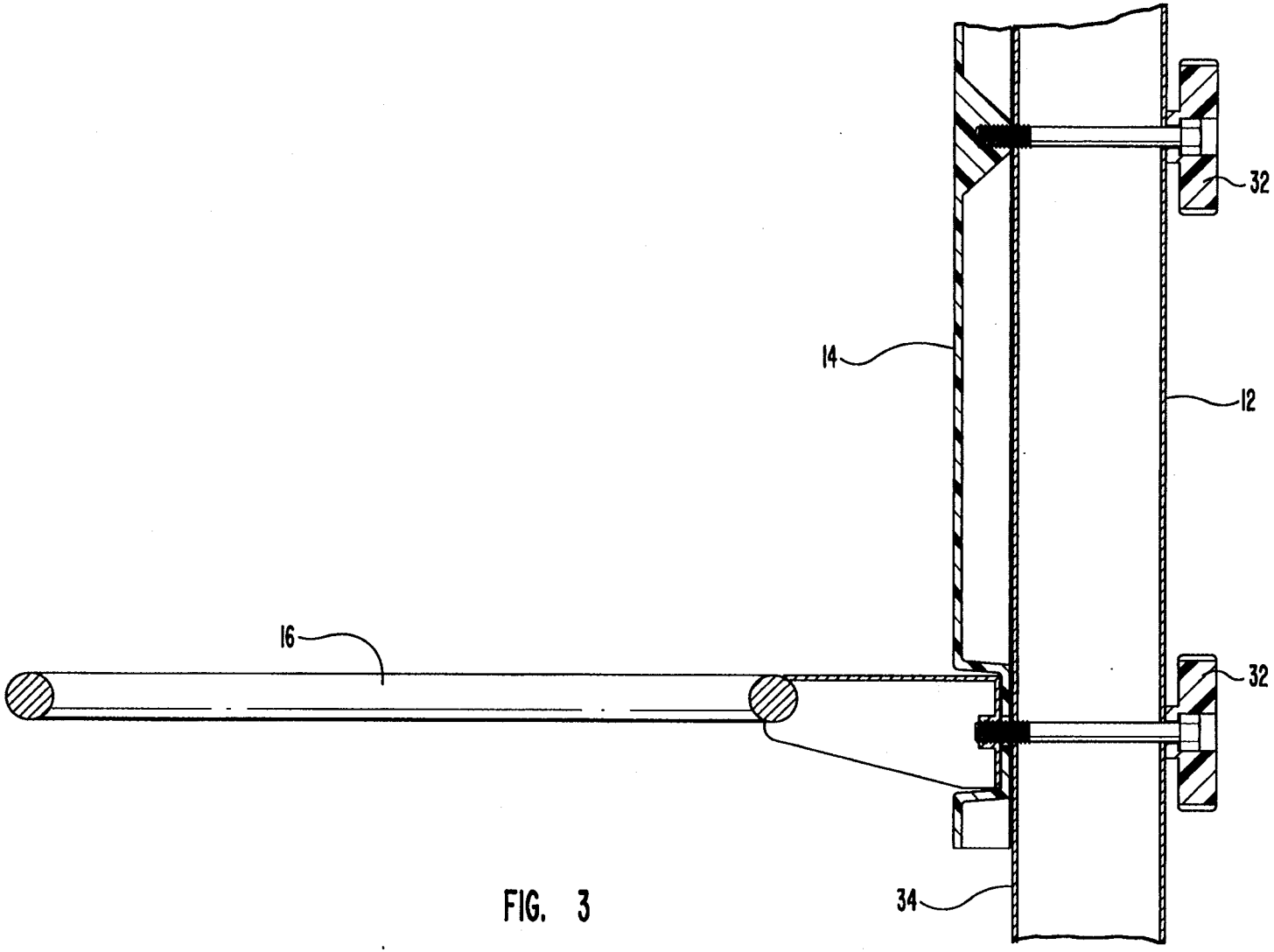
FIG. 3 is a cross-sectional view taken along line 3—3 of FIG. 1 illustrating a method of attaching the backboard and basketball goal to the pole.

The backboard 14 and basketball goal 16 may be connected to the pole 12 near the distal end 24 of the pole 12 in any customary fashion that secures the plane of the backboard 14 in a vertical plane. FIG. 3 illustrates one particularly preferred manner of attaching the backboard 14 and goal 16 to the pole 12. As shown, the means for affixing the backboard 14 and goal 16 to the pole 12 include threaded fasteners 32 which may be manually tightened without hand tools. The pole surface 34 against which the backboard 14 and basketball goal 16 are affixed is preferably flattened somewhat to provide greater stability to the backboard 14 and goal 16. Those skilled in the art will appreciate that the interface between the pole 12 and the backboard 14 and goal 16 may be modified in other ways besides flattening to improve stability. A plurality of holes 36 are provided in the distal end 24 of the pole 12 to permit the basketball goal 16 and backboard 14 to be attached to the pole 12 at different vertical heights.

Figure 2:
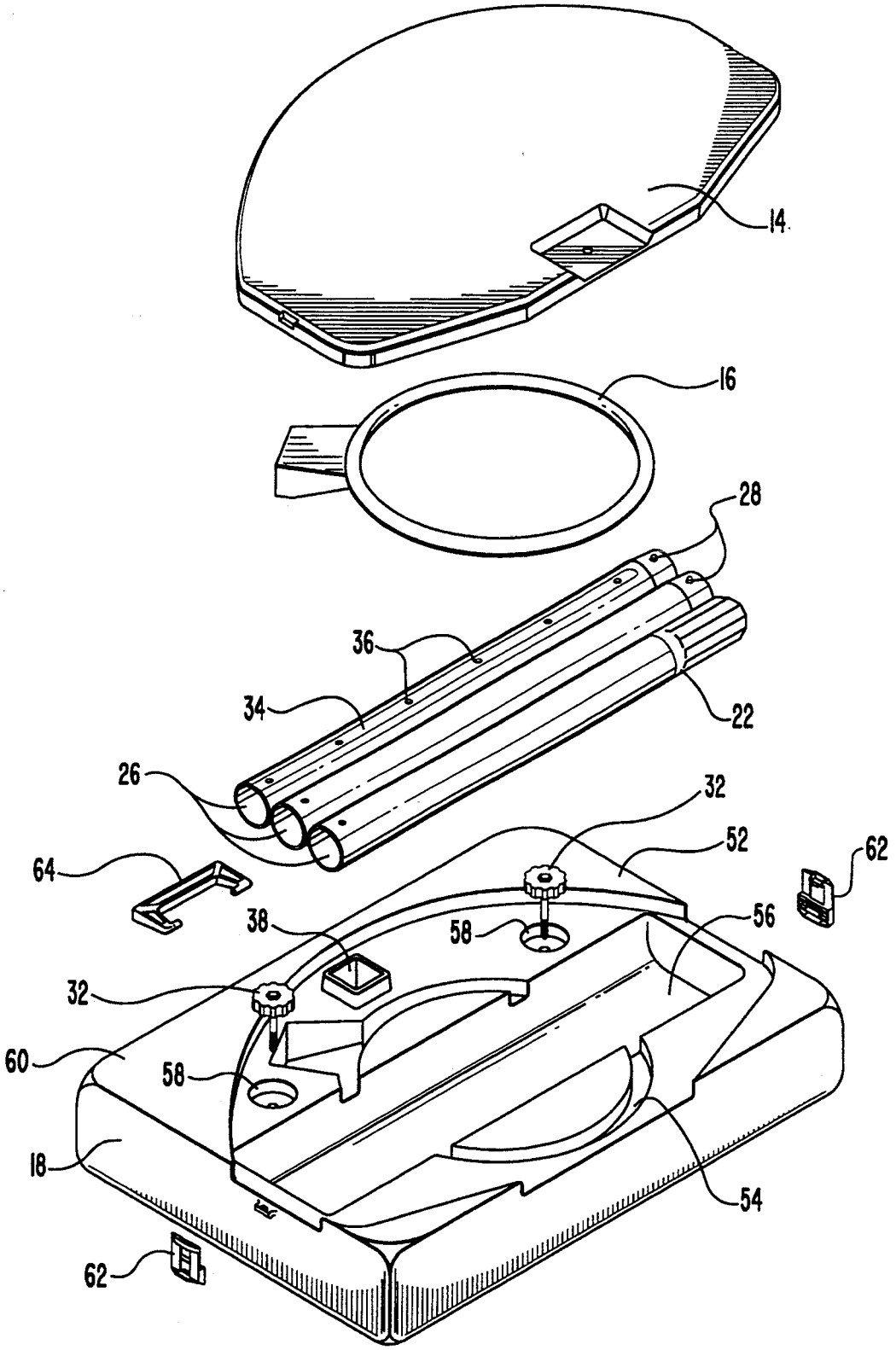
FIG. 2 is an exploded perspective view of the component parts of the present invention and how they fit within the recesses molded in the base.

The basketball goal 16 illustrated in FIGS. 1–3 does not have conventional net hooks, such that plastic, break away net retainers may be used. However, those skilled in the art will appreciate that various means for affixing the net to the basketball goal may be used, including conventional net hooks.

The base 18 includes a pole anchor 38 which receives and supports the pole 12 in a stationary, substantially upward disposition. The proximal end 22 of the pole 12 is preferably shaped in the form of a square to fit securely within the pole anchor 38. The base 18 is preferably constructed of a strong, lightweight plastic material. A metal sleeve (not shown) is preferably included in the pole anchor 38 to enhance pole stability and to prevent the pole 12 from damaging or puncturing a hole in the base 18.

Figure 5:
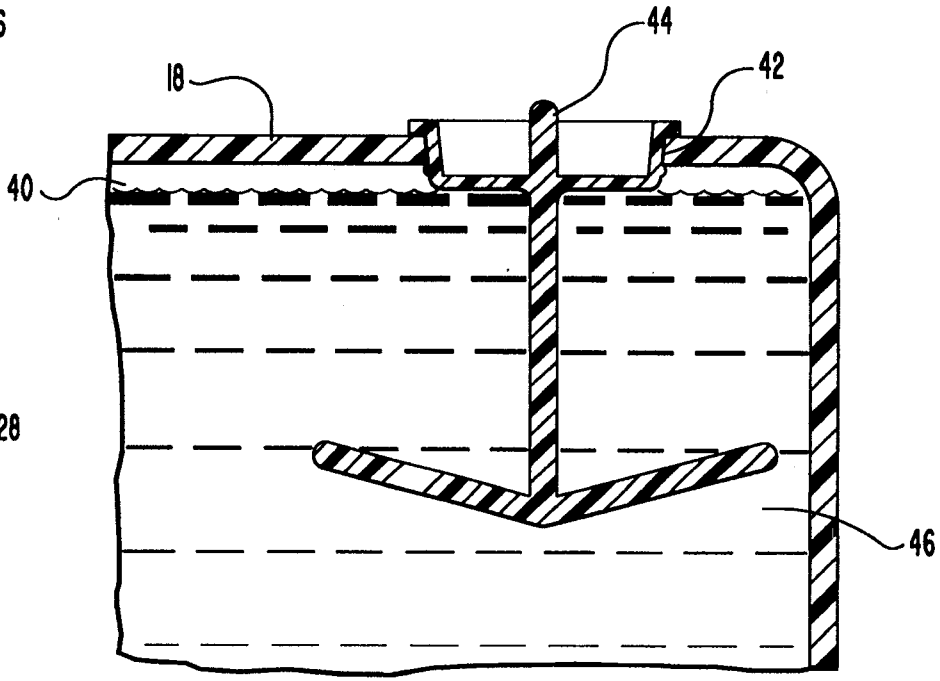
FIG. 5 is a cross-sectional view taken along line 5—5 of FIG. 1 illustrating a cap for filling and retaining the base with water.

In a currently preferred embodiment of the present invention, the base 18 has a generally rectangular three-dimensional shape with a top and a bottom surface. The base 18 preferably has an interior hollow cavity 40 (shown in FIG. 5) for receiving ballast material. The hollow cavity 40 is accessed through an opening 42, preferably disposed on the top surface of the base 18. A cap 44 is provided to cover the opening 42 so that the hollow cavity can be made water tight. One possible cap 44 which may be used in the present invention is illustrated in FIG. 5.

The ballast material used to provide the weight needed to securely anchor the basketball system to the playing surface during a game mode may be water or a solid particle ballast such as sand, soil, metal beads or the like. Water 46, shown in FIG. 5, is the currently preferred ballast material. The weight of the ballast material provides sufficient support to the basketball system to maintain the system in a substantially rigid position during use of the basketball system. The water 46 within the base 18 may also be quickly drained to render the basketball system lightweight for transport.

As shown in FIG. 2, the base 18 preferably has an exterior contour for receiving and retaining the pole sections 26, basketball goal 16, backboard 14, and threaded fasteners 32 for attaching the backboard 14 and goal 16 to the pole 12. The exterior contour of the base 18 accommodates the receipt and retention of the component parts of the basketball system in an assemblage that impedes shifting movement of the component parts during transport.

The exterior contour of the base 18 includes a backboard recess 52, a goal recess 54, a pole recess 56, and a fastener recess 58, for receiving and retaining the backboard 14, goal 16, pole sections 26, and threaded fasteners 32, respectively. The recesses are preferably provided on the bottom surface 60 of the base 18. The pole recess 56, for example, is of the depth, size and shape for receiving and retaining the pole sections 26 in secure but removable engagement. Likewise, the goal recess 54 receives and retains the basketball goal 16 in snug but removable engagement. The backboard recess 52 is of a size and shape for receiving and retaining the backboard 14 in fitted, removable engagement. Finally, the fastener recesses 58 are configured to retain the threaded fasteners 32 used to attach the backboard 14 and basketball goal 16 to the pole 12.

With the component parts of the basketball system retained within their respective recesses, the assemblage has compact exterior dimensions for easy storage and transport. The backboard 14 preferably functions as a lid in combination with the base recesses to hold the component parts snugly and to impede the shifting movement of the parts during transport. Clips 62 are preferably provided on the base 18 to engage the backboard 14 and hold it in place within the backboard recess 52. When disassembled, the basketball system is readily moved by using a handle 64 located on the exterior surface of the base 18, much like a suitcase. Those skilled in the art will appreciate that a handle or other carrying means may be integrally molded into the base or may even be affixed to the backboard.

From the foregoing, it will be appreciated that the present invention provides a truly portable basketball system which can be quickly assembled, disassembled, and transported as a lightweight, compact basketball system. Because the present invention includes a hollow, ballast fillable base, the basketball system with ballast provides sufficient weight to maintain the basketball goal 16 in a generally rigid position, yet without ballast, the basketball system is lightweight for easy transport. The present invention may also be assembled and disassembled without the need for hand tools.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable basketball system comprising:

a plurality of pole sections capable of assembly to form a pole having a proximal end and a distal end;

a backboard for connection to said pole near the distal end of said pole;

a basketball goal for connection to said pole; and a hollow ballast-receiving base capable of assembly with said pole, backboard, and basketball goal to form the basketball system wherein said base supports said pole in a stationary, substantially upward disposition and is connected to said pole near the proximal end of said pole and wherein said basketball goal and said backboard are connected to said pole so that said basketball goal is suspended at an elevation above said base, said base having an exterior contour for receiving and retaining said pole sections, backboard, and basketball goal and for impeding shifting movement of said pole sections, backboard, and basketball goal during transport of said base.

2. A portable basketball system as defined in claim 1, wherein the exterior contour of the base comprises:

a pole recess for receiving and retaining the pole sections;

a goal recess for receiving and retaining the basketball goal; and a backboard recess for receiving and retaining the backboard.

3. A portable basketball system as defined in claim 1, wherein the base further comprises an opening into a hollow cavity within the base and a cap for covering said opening such that said hollow cavity is water-tight, whereby said hollow cavity is capable of receiving and retaining water as ballast.

4. A portable basketball system as defined in claim 1, wherein the base further comprises an opening into a hollow cavity within the base and a cap for covering said opening such that the hollow cavity is capable of receiving and retaining solid particles as ballast.

5. A portable basketball system as defined in claim 1, wherein the base has a top side and a bottom side and the backboard recess is disposed in the bottom side of the base.

6. A portable basketball system as defined in claim 5, wherein the goal recess is disposed in the bottom side of the base.

7. A portable basketball system as defined in claim 5, wherein the pole recess is disposed in the bottom side of the base.

8. A portable basketball system as defined in claim 5, wherein the backboard acts as a lid to retain the goal and the pole within the base if disposed and retained in the backboard recess.

9. A portable basketball system as defined in claim 8, further comprising means for retaining the backboard within the backboard recess.

10. A portable basketball system as defined in claim 8, wherein the base further comprises a handle for transporting the base, pole sections, goal, and backboard.

11. A portable basketball system as defined in claim 1, wherein the basketball goal and backboard may be connected to the pole at different vertical locations so that the basketball goal is suspended at varying elevations above the base.

12. A portable basketball system as defined in claim 1, wherein the basketball goal and backboard may be manually connected to the pole without the need for hand tools.

13. A portable basketball system comprising:

a plurality of pole sections capable of assembly to form a pole having a proximal end and a distal end;

a backboard for connection to said pole near the distal end of said pole;

a basketball goal for connection to said pole;

means for affixing said backboard and said basketball goal to said pole; and a hollow ballast-receiving base capable of assembly with said pole, backboard, and basketball goal to form the basketball system wherein said base supports said pole in a stationary, substantially upward disposition and is connected to said pole near the proximal end of said pole and wherein said basketball goal and said backboard are connected to said pole so that said basketball goal is suspended at an elevation above said base, said base having an exterior contour for receiving and retaining said pole sections, backboard, and basketball goal and for impeding shifting movement of said pole sections, backboard, and basketball goal during transport of said base, wherein the exterior contour of the base comprises:

a pole recess for receiving and retaining the pole sections;

a goal recess for receiving and retaining said basketball goal; and a backboard recess for receiving and retaining said backboard.

14. A portable basketball system as defined in claim 13, wherein said base has a top side and a bottom side and the backboard recess, goal recess, and pole recess are disposed in the bottom side of said base.

15. A portable basketball system as defined in claim 14, wherein the backboard acts as a lid to retain the goal and the pole within the base if disposed and retained in the backboard recess.

16. A portable basketball system as defined in claim 15, further comprising means for retaining the backboard within the backboard recess.

17. A portable basketball system as defined in claim 15, wherein the base further comprises a handle for transporting the base, pole sections, goal, and backboard.

18. A portable basketball system as defined in claim 13, wherein the base further comprises an opening into a hollow cavity within the base and a cap for covering said opening such that said hollow cavity is water-tight, whereby said hollow cavity is capable of receiving and retaining water as ballast.

19. A portable basketball system as defined in claim 13, wherein the base further comprises an opening into a hollow cavity within the base and a cap for covering said opening such that the hollow cavity is capable of receiving and retaining solid particles as ballast.

20. A portable basketball system as defined in claim 13, wherein the basketball goal and backboard may be connected to the pole at different vertical locations so that the basketball goal is suspended at varying elevations above the base.

21. A portable basketball system as defined in claim 13, wherein the basketball goal and backboard may be manually connected to the pole without the need for hand tools.

22. A portable basketball system comprising:

a plurality of pole sections capable of assembly to form a pole having a proximal end and a distal end;

a backboard for connection to said pole near the distal end of said pole;

a basketball goal for connection to said pole;

means for affixing said backboard and said basketball goal to said pole; and a hollow ballast-receiving base capable of assembly with said pole, backboard, and basketball goal to form the basketball system wherein said base supports said pole in a stationary, substantially upward disposition and is connected to said pole near the proximal end of said pole and wherein said basketball goal and said backboard are connected to said pole so that said basketball goal is suspended at an elevation above said base and wherein said basketball goal and backboard may be connected to said pole at different vertical locations, said base having an exterior contour for receiving and retaining said pole sections, backboard, and basketball goal and for impeding shifting movement of said pole sections, backboard, and basketball goal during transport of said base, wherein the exterior contour of the base comprises:

a pole recess for receiving and retaining the pole sections;

a goal recess for receiving and retaining said basketball goal; and a backboard recess for receiving and retaining said backboard;

wherein said base has a top side and a bottom side and said pole, goal, and backboard recesses are disposed in the bottom side of said base, and wherein said backboard acts as a lid to retain the goal and the pole within the base if disposed and retained in the backboard recess.

23. A portable basketball system as defined in claim 22, further comprising means for retaining the backboard within the backboard recess.

24. A portable basketball system as defined in claim 23, wherein the base further comprises a handle for transporting the base, pole sections, goal, and backboard.

25. A portable basketball system as defined in claim 24, wherein the base further comprises an opening into a hollow cavity within the base and a cap for covering said opening such that said hollow cavity is water-tight, whereby said hollow cavity is capable of receiving and retaining water as ballast.

26. A portable basketball system as defined in claim 24, wherein the base further comprises an opening into a hollow cavity within the base and a cap for covering said opening such that the hollow cavity is capable of receiving and retaining solid particles as ballast.

27. A portable basketball system as defined in claim 24, wherein the basketball goal and backboard may be manually connected to the pole without the need for hand tools.

28. A method of assembling a basketball system comprising the steps of:

(a) obtaining a portable basketball system assemblage comprising:

a plurality of pole sections capable of assembly to form a pole;

a backboard for connection to said pole;

a basketball goal for connection to said pole;

means for affixing said backboard and said basketball goal to said pole; and a base having exterior recesses for receiving and retaining said plurality of pole sections, backboard, basketball goal, and affixing means, and for impeding shifting movement of said pole sections, backboard, basketball goal, and affixing means during transport of said base, said base having means for supporting said pole in a stationary, substantially upward disposition, wherein said backboard acts as a lid to said base for retaining the goal and the pole within the base if said backboard is disposed and retained in the backboard recess;

(b) assembling the plurality of pole sections to form a pole;

(c) securing the pole to the base such that the base supports the pole in a substantially upward disposition;

(d) affixing the backboard to the pole; and (e) affixing the basketball goal to the pole.

29. A method of assembling a basketball system as defined in claim 28, wherein the base is hollow and capable of receiving ballast.

30. A method of assembling a basketball system as defined in claim 29, further comprising the step of placing ballast within the base.

31. A method of assembling a basketball system as defined in claim 28, wherein the backboard and the basketball goal are manually affixed to the pole without the aid of hand tools.

32. A method of disassembling a basketball system to form a portable basketball system assemblage comprising the steps of:

(a) disassembling a basketball system into its component parts, said component parts comprising:

a plurality of pole sections;

a basketball goal;

a backboard; and a base having an exterior contour comprising a pole recess for receiving and retaining the plurality of pole sections, a goal recess for receiving and retaining the basketball goal, and a backboard recess for receiving and retaining the backboard, said base having means for retaining the backboard within the backboard recess;

(b) placing the plurality of pole sections within the pole recess;

(c) placing the basketball goal within the goal recess;

(d) placing the backboard within the backboard recess; and (e) securing the backboard within the backboard recess such that the backboard acts as a lid to said base for retaining the pole sections and basketball goal within the base and for impeding shifting movement of the pole sections, backboard, and basketball goal during transport of said base.

33. A method of disassembling a basketball system as defined in claim 32, wherein the step of disassembling the basketball system further includes the step of removing ballast from within the base.

* * * * *